United States Patent [19]

Paul

[11] 4,079,690

[45] Mar. 21, 1978

[54] ELECTRONIC LINE COUPLER

[76] Inventor: William A. Paul, 1808 Parkside Blvd., Toledo, Ohio 43607

[21] Appl. No.: 695,655

[22] Filed: Jun. 14, 1976

[51] Int. Cl.[2] ..... B63B 21/00

[52] U.S. Cl. ..... 114/230

[58] Field of Search ..... 114/218, 230, 235 R, 114/235 WS, 235 A, 249, 250, 251, 252; 24/211 L; 287/90 B, 90 D, 103 A; 285/317

[56] References Cited

U.S. PATENT DOCUMENTS

| | | | |
|---|---|---|---|
| 1,119,252 | 12/1914 | Donnell | 114/218 |
| 2,550,913 | 5/1951 | Coffing | 114/230 |
| 3,134,154 | 5/1964 | Smith et al. | 114/230 |
| 3,196,824 | 7/1965 | Howard | 114/230 |
| 3,397,433 | 8/1968 | Whitehill | 24/211 L |
| 3,793,685 | 2/1974 | Knecht | 114/230 |

*Primary Examiner*—Trygve M. Blix
*Assistant Examiner*—Jesus D. Sotelo
*Attorney, Agent, or Firm*—Allen D. Gutchess, Jr.

[57] ABSTRACT

An electronic line coupler for a boat is provided. The line coupler connects a mooring line from a dock or mooring post to the boat. One end of the line is suitably attached to the dock or post and the other end of the line is attached to a projection. The projection is received in a recess of the boat with the recess preferably being located in a cleat. A latch holds the projection in the recess when inserted thereinto and securely holds the line until the latch is released. In a preferred form, the latch is electrically-operated by an operator or pilot located at the boat controls or other desired position. The operator can then release the latch to uncouple the line projection from the recess when he wishes to cast off and leave the dock or post. The line is preferably equipped with an elastic connection between two spaced portions thereof to aid in urging the line projection from the boat recess and to aid in holding it above the water level.

4 Claims, 4 Drawing Figures

FIG. 1
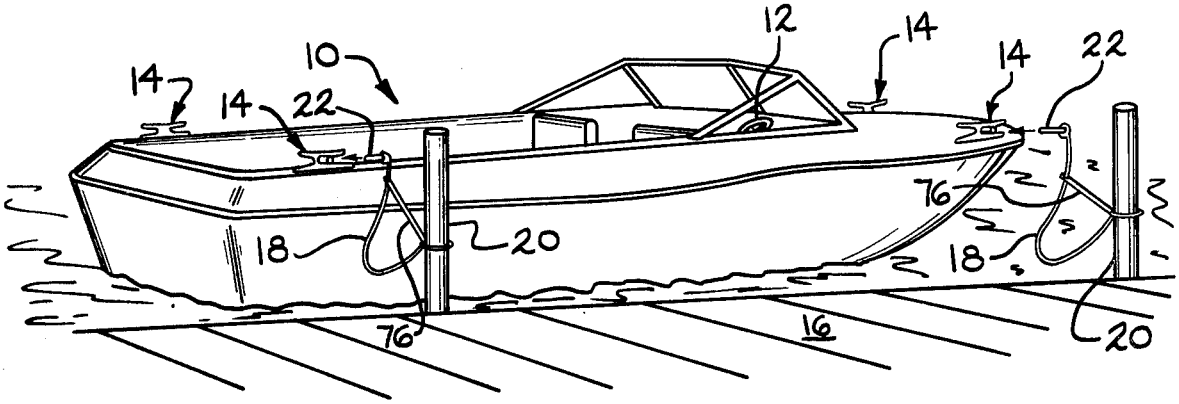
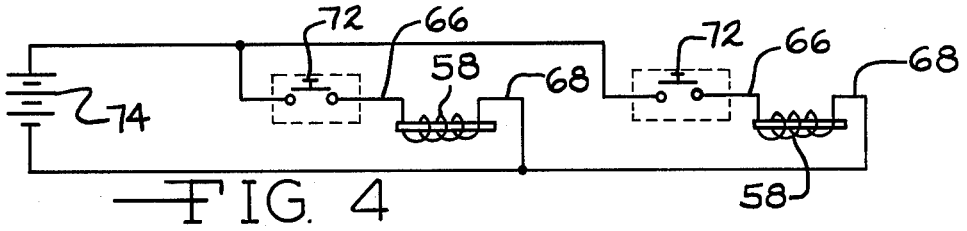
FIG. 4
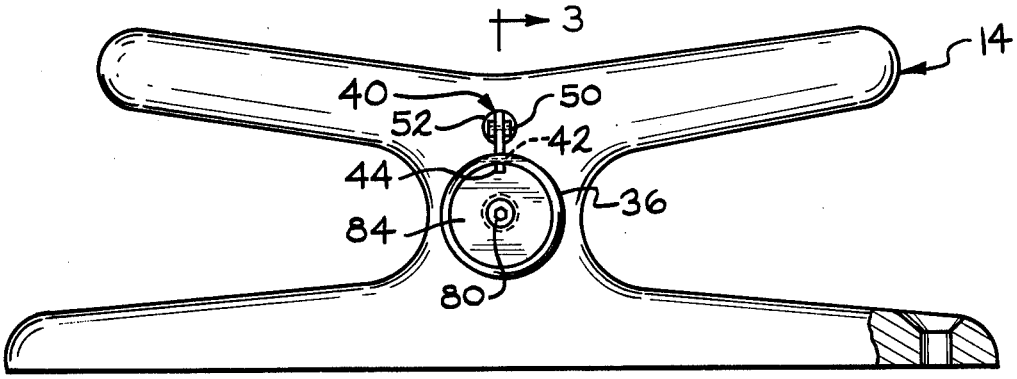
FIG. 2
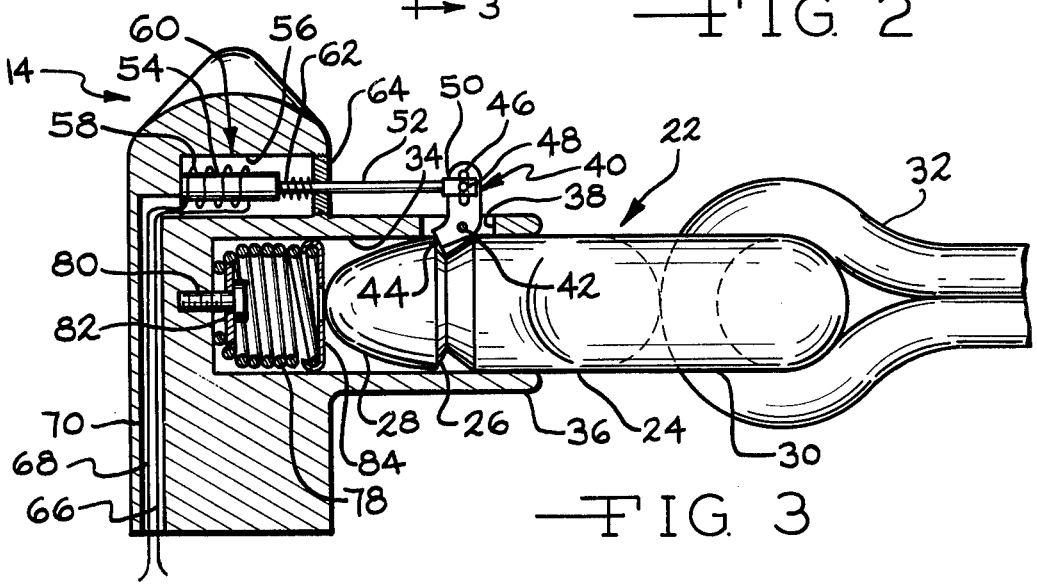
FIG. 3

ELECTRONIC LINE COUPLER

This invention relates to a line coupler for connecting a mooring line to a boat and for releasing same.

Even small boats can be difficult to release from their mooring lines when an operator or pilot wishes to cast off from the mooring unit, e.g. a dock or mooring post. Particularly when wind or waves are present, the boat may swing away when some mooring lines are released so that the boat may be out of the desired position when the last of the lines are released. Further, when the last line is released, the boat may be blown or pushed by the waves toward the shore and be in excessively shallow water by the time the operator can start or control the propelling means to place the boat under power and direct it away from the dock or mooring area.

The present invention provides line couplers which enable mooring lines to be connected to a boat and enable the pilot or operator to uncouple or release the lines from a position at which he has control of the boat or the propelling means therefor. Each line coupling assembly includes a line which has one end affixed to the dock or a mooring post and has a projection attached to the other end. The boat has means forming a recess to receive the projection, with the recess means preferably being formed in a cleat. When the projection is inserted into the recess, a latch therein automatically holds the projection in place. The latch can be remotely operated by an operator at the controls or at the propelling means for the boat. Thus, when the line is cast off by the release of the latch, the boat will be immediately under the control of the operator so that he can maneuver it away from the dock or mooring area without danger of being blown against the dock or into an undesirable position.

In a preferred form, the mooring line has a resilient strap or elongate member connected to spaced portions thereof with this line being under tension when the mooring line is connected to both the mooring unit and the boat. When the line is released, the resilient strap aids in pulling the line from the recess and also then holds the line, and particularly the projection end thereof, above the water level.

It is, therefore, a principal object of the invention to provide apparatus for facilitating the connecting to and releasing of a boat from a mooring unit.

Another object of the invention is to provide means for casting off a mooring line from a remote location.

A further object of the invention is to provide recess means having a remotely-operated latch for holding a mooring line projection in the recess and for releasing same.

Many other objects and advantages of the invention will be apparent from the following detailed description of a preferred embodiment thereof, references being made to the accompanying drawing, in which:

FIG. 1 is a view in perspective of a boat and a dock having a post carrying a mooring line and connectable by a coupling device to the boat in accordance with the invention;

FIG. 2 is a front view in elevation of the coupling device of FIG. 1;

FIG. 3 is an enlarged view in transverse cross section taken along the line 3—3 of FIG. 2; and FIG. 4 is a diagrammatic view of an electrical circuit for operating the coupling devices.

Referring to FIG. 1, a boat embodying the invention is indicated at 10 and is shown as an inboard type with a steering wheel 12 by which the boat can be steered and controlled. The invention can also be used advantageously with boats having other drive or propelling means, including inboard-outboard units, outboards, and even sails. The boat 10, as shown, has four cleats 14 with which the boat can be moored to a dock 16 or the like.

Mooring lines 18 are each shown as having one end connected to a mooring unit in the form of a dock post or mooring post 20, the end encircling the post. The opposite end of each of the lines 18 has a coupling member or projection 22. As shown in FIG. 3, the projection 22 has an elongate portion 24 with a shoulder 26 and a tapered end 28. The opposite end of the projection has a suitable ring 30 formed thereon which receives a loop 32 at the end of the line 18.

The boat, and specifically the cleat 14, has a projection-receiving recess or cavity 34 formed therein, in this instance, with the aid of an extension or sleeve 36. The sleeve 36 has a slot 38 through which a latch or retaining element 40 extends, being pivotally supported by a pin 42 extending across the slot 38 and held by the sleeve. The latch 40 has an engagable end or portion 44 which engages the projection shoulder 26 when the projection 22 is inserted into the recess 34 to thereby hold the projection in the recess.

Various configurations and arrangements of the projection and the latching arrangement will be readily apparent to those skilled in the art and the specific projection and latch designs are shown only for illustrative purposes.

The latch 40 is preferably remotely operated and, for this purpose, it has a slot 46 through which a pin 48 extends to connect the outer end of the latch to a yoke 50. The yoke is connected to a rod 52 terminating in a solenoid core 54 in a solenoid chamber 56 which can also be formed in the cleat 14. A solenoid coil 58 of a solenoid generally indicated at 60 is also in the recess 56, surrounding the core 54. A spring 62 located around the inner end of the rod 52 is positioned between an end of the core 54 and a chamber plug 64. The spring 64 thereby urges the core 54 away from the latch 40 to urge the end 44 of the latch into the recess 34 so as to engage the shoulder 26 of the projection 22 when inserted into the recess. When the coil 58 is energized, it overcomes the force of the spring 62, thereby moving the core 54 outwardly to move the latch in a clockwise direction and release the engagable end 44 thereof from the shoulder 26.

The coil 58 of the solenoid 60 can be remotely operated from the operator's location at the steering wheel 12 or other propelling means or control device of the boat. For this purpose, a pair of wires or conductors 66 and 68 can extend through a suitable bore 70 in the cleat and under the deck to the operator's location. As shown in FIG. 4, the conductors can be connected through push button switches 72 to a suitable power source, shown as a battery 74. The switches can be mounted on a panel near the steering wheel 12. When either of the switches 72 is closed, the corresponding solenoid coil 58 is energized to release the latch 40 and enable the projection 22 to be withdrawn from the recess 34.

The projection 22 will usually be withdrawn immediately because each of the mooring lines 18 preferably is equipped with a resilient elongate member or strap 76 connected to spaced portions thereof and placed under tension when the projection 22 is held in the recess 34. Further, when the projection is released, the resilient strap 76 aids in holding the line 18 and specifically the projection end above the water level.

Each of the recesses can be equipped with a coil spring 78 at the inner end thereof which is compressed when the projection is inserted into the recess and engaged by the latch 40. This provides assurance that when the latches 40 are operated, the projections 22 will be expelled from the recesses 34, whether or not the straps 76 are used. As shown, the spring 78 can be mounted in the recess by a suitable screw 80 and a washer 82, with the outer end of the spring having a cap 84 which engages the tapered end 28 of the projection 22.

From the above, it will be readily seen that the operator can release the boat from the dock without leaving the steering wheel 12 or leaving the controls or the propelling means for the boat. This prevents the possibility of the stern swinging away from the dock when the stern line is cast off with the boat then pointing toward the dock when the front line is released, which can cause the boat to hit the dock when it is first underway. Also, the boat can be immediately placed underway when the last line is cast off to prevent the boat from being blown or pushed into shallow water or some other undersirable location before the operator can establish control of the boat and place it under power.

If desired, only one of the lines 18 can be provided with the projection 22 and the coupling device. In that instance, all of the other lines can be manually released and then the final line released or cast off after the operator is at the control location and ready to direct the boat away from the mooring unit.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for aiding in the casting off of a boat from a mooring unit, said apparatus including, in combination, a mooring line for connection to the mooring unit, a projection connected to said mooring line, holding means on the boat for receiving said projection, said holding means including latch means having a first position engagable with said projection and a second position out of engagement with said projection, said holding means also having a spring having an end cap directly engaged and compressed by said projection when said latch means engages said projection in the first position, whereby said spring will urge said projection away from said holding means when said latch means is moved from the first position to the second position, and remotely-operated means for moving said latch means from the first position to the second position.

2. Apparatus according to claim 1 characterized by said mooring line having a resilient strap connected between two spaced portions thereof, said strap being under tension when said projection is held by said holding means, said strap being effective to hold said projection above the water level when said projection is released from said holding means.

3. Apparatus for aiding in connecting a boat to a mooring unit, said apparatus comprising means forming a recess in said boat, a projection for being connected to an end of a mooring line which is connectable to said mooring unit, said projection having an elongate portion, a shoulder, and a tapered end, latch means having a first position extending into said recess for engaging said shoulder and holding said projection when inserted thereinto and having a second position spaced from said projection shoulder, and remotely-controlled means for moving said latch means from the first position to the second position, said remotely-controlled means comprising a solenoid connected to said latch means and switch means located at an operator's location for actuating said solenoid.

4. Apparatus according to claim 3 characterized by resilient means in said recess engaged and compressed by the tapered end of said projection when said latch means engages the shoulder whereby said resilient means will eject said projection from said recess when said latch means is moved from the first position to the second position.

* * * * *